US010492271B2

(12) United States Patent
Harwood

(10) Patent No.: US 10,492,271 B2
(45) Date of Patent: Nov. 26, 2019

(54) FASTCAP WITH WIRELESS INTERFACE AND CONTROL FOR LUMINAIRE

(71) Applicant: Ronald P. Harwood, West Bloomfield, MI (US)

(72) Inventor: Ronald P. Harwood, West Bloomfield, MI (US)

( * ) Notice: Subject to any disclaimer, the term of this patent is extended or adjusted under 35 U.S.C. 154(b) by 0 days.

(21) Appl. No.: 15/937,722

(22) Filed: Mar. 27, 2018

(65) Prior Publication Data

US 2018/0279445 A1 Sep. 27, 2018

Related U.S. Application Data

(60) Provisional application No. 62/477,334, filed on Mar. 27, 2017, provisional application No. 62/477,337, filed on Mar. 27, 2017.

(51) Int. Cl.

| | |
|---|---|
| ***H05B 37/02*** | (2006.01) |
| ***H01Q 1/44*** | (2006.01) |
| ***F21S 8/08*** | (2006.01) |
| ***H01Q 1/12*** | (2006.01) |
| ***F21V 23/00*** | (2015.01) |
| ***F21V 23/02*** | (2006.01) |
| *F21W 131/10* | (2006.01) |

(52) U.S. Cl.

CPC ..... *H05B 37/02* (2013.01); *F21S 8/085* (2013.01); *F21V 23/009* (2013.01); *F21V 23/026* (2013.01); *H01Q 1/12* (2013.01); *H01Q 1/44* (2013.01); *F21W 2131/10* (2013.01)

(58) Field of Classification Search

CPC ... F21S 8/08; F21S 8/085; F21S 8/088; F21V 21/08; B63B 45/00; B63B 2201/04; B63B 2724/00; G08G 1/095; G08G 1/0955; H01Q 1/12; H01Q 1/12017

USPC ..... 362/431, 439

See application file for complete search history.

(56) References Cited

U.S. PATENT DOCUMENTS

| | | | | |
|---|---|---|---|---|
| 8,631,998 | B1 * | 1/2014 | Connelly | A47G 29/1216 232/39 |
| 2005/0230979 | A1 * | 10/2005 | Bywaters | F03D 7/0248 290/44 |
| 2010/0231469 | A1 | 9/2010 | Kim | |
| 2015/0346320 | A1 * | 12/2015 | Hartman | H05B 37/0227 315/312 |
| 2015/0349399 | A1 | 12/2015 | Lasier | |
| 2017/0122546 | A1 | 5/2017 | Abbott | |
| 2018/0094782 | A1 * | 4/2018 | Chiang | E04H 12/08 |

* cited by examiner

*Primary Examiner* — Sean P Gramling
*Assistant Examiner* — Keith G. Delahoussaye

(57) ABSTRACT

Control devices for controlling, switching or otherwise manipulating power and/or other operations of luminaires and/or other devices connected thereto via power, data or other connectors or interfaces are contemplated. The control devices may be included as part of a cap to facilitate a fast connection or a fast installation in a manner sufficient to be characterized as a FastCap™.

2 Claims, 1 Drawing Sheet

FASTCAP WITH WIRELESS INTERFACE AND CONTROL FOR LUMINAIRE

CROSS-REFERENCE TO RELATED APPLICATIONS

This the benefit of U.S. provisional Application Nos. 62/477,334 and 62/477,337, filed Mar. 27, 2017, the disclosures of which are incorporated in their entireties by reference herein.

TECHNICAL FIELD

The present invention relates to control devices for controlling, switching or otherwise manipulating power and/or other operations of luminaires and/or other devices connected thereto via power, data or other connectors or interfaces.

BACKGROUND

The outdoor lighting industry manufactures lights and purchase wired and wireless controllers from third party vendors to control lighting, measure energy and provide data feedback related to the performance of the controllers and lights. The various controller and lighting manufacturers have not created standard products that have similar dimensional or electrical characteristics. Further, luminaire manufacturers are required to re-certify the safety tests (Underwriters Labs or ETL Labs) in order to place the controllers within the luminaires. There are controllers that physically attach to the luminaire through an external facing socket but these too must be tested and approved.

One non-limiting aspect of the present invention contemplates addressing the foregoing shortcomings a design that allows controllers to be physically independent from the luminaire while at the same time controlling it, which may also eliminate requirements for testing of the luminaire.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 2:
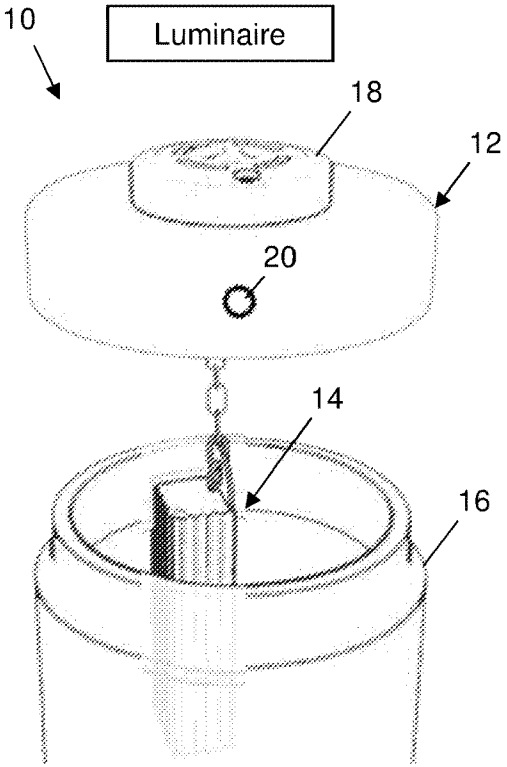
FIGS. 1 and 2 illustrate a lighting system in accordance with one non-limiting aspect of the present invention.
Figure 1:
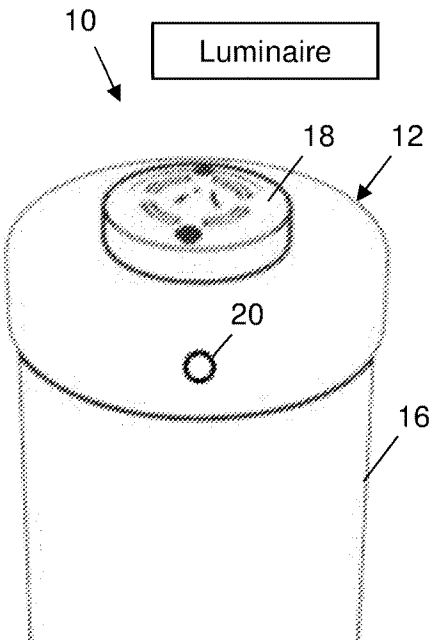

FIGS. 1 and 2 illustrate a lighting system 10 in accordance with one non-limiting aspect of the present invention. The lighting system 10 is shown to include a cap 12 having one or more control devices 14 included therewith being attached to a light pole 16 at one end and at an opposite end via a connector 18 to a luminaire (not shown). A housing of the cap 12 may be threaded or otherwise connected to a male receiver included on the light pole 16 and secured thereto with a fastener 20 in such a manner as to facilitate a fast connection or a fast installation so as to be characterized as a FastCap™. The connector 18 may be sufficient to facilitate interfacing prongs or other connection mechanisms on the luminaire with the one or more control devices 14, such as to facilitate interfacing power, data or other signaling therebetween. The control devices 14, which may include power sources and/or other features associated with the cap 12, may be suspended by a chain or other connections/mechanism to dangle within an interior of the light pole 16 without having to be directly connected to the light pole 16, i.e., the control elements may be entirely suspended from the cap 12.

Figure 3:
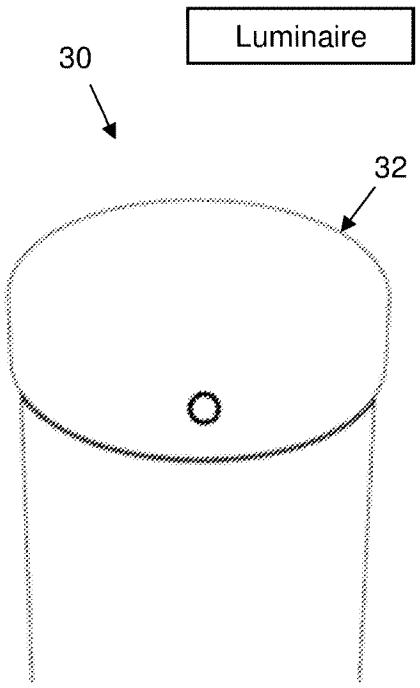
FIG. 3 illustrates another lighting system in accordance with one non-limiting aspect of the present invention.

FIG. 3 illustrates another lighting system 30 in accordance with one non-limiting aspect of the present invention. The lighting system 30 is similar to the lighting system 10 described above with respect to a cap 32 being attached to the light pole and including a plurality of control devices suspended therefrom within an interior a light pole (not shown). The lighting system 30 may be differentiated from the lighting system 10 described above in that the connector 18 is omitted from the cap 32, which may be beneficial when the luminaire is connected thereto wirelessly and/or through other mechanisms and/or when the control devices may not interface directly with the luminaire, such as when providing wireless instructions or otherwise wirelessly interfacing with the luminaire or other devices within proximity thereto using antennas and other componentry dangled within the light pole and optionally interface through punch outs (not shown) with the ambient environment. The control devices may optionally be consistent with those described in U.S. patent application Ser. Nos. 14/753,611 and 15/803,905, the disclosures of which are hereby incorporated by reference in their entireties herein.

The cap allows controllers to be easily accessible to the service provider without opening the seals on the luminaire. The cap also allows any form of antenna, indicator light or accessory to be mounted. A flat cap that slips onto the pole that as an adapter of any kind on it. It solves the issue of UL listings when integrating controls into a lighting system. There are multiple formats: a cap so that a receptacle or device can be installed on top of the cap and/a cap that has hanging hardware and a place to mount an antenna or more. The invention describes a method by which a cap is installed on the supporting pole of the luminaire. The cap has multiple uses including but not limited to the ability to install control devices, antennas and beacons attached to the cap and support antennas. The cap can slip over the pole with either a male or female receiver. The cap can have a flat or articulated top portion as necessary to perform the anticipated functions including but not limited to a beacon light. The cap can have a built-in receptacle to accept any control device above or below the cap. The cap can have one or more suspension devices on the upper surface or the bottom surface. The suspension devices can be (but not limited to) rings, eyelets, hooks, fasteners. Retention of the cap can be (but is not limited to) set screws, clamps, threads, compression rings.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A cap for wireless controlling a luminaire attached to an exterior portion of a light pole when the luminaire lacks a wireless interface sufficient for wirelessly receiving data needed for a controller of the luminaire to correspondingly control operations thereat, the cap comprising:

a connector electrically interfacing with the controller;

a housing removably secured with a fastener to an open end of the light pole;

a control device having a wireless interface for receiving messages wirelessly transmitted thereto, the control device generating the data according to information included in the messages and relatedly interfacing the data with the controller via the connector to correspondingly control operations thereat, thereby enabling wireless control when the luminaire lacks the wireless interface for receiving the messages; and a movable suspension attached to the housing for positioning the control device below the open end within an interior of the light pole such that the control device dangles within the interior without any portion of the control device, the moveable suspension and the housing contacting interior sides of the light pole below the open end.

2. The cap of claim 1 wherein the luminaire has a certification of operation independent of the cap such that subsequent use of the cap is independent of the certification and enables the luminaire to be wirelessly controlled without having to recertify the certification.

* * * * *